US007144307B2

(12) United States Patent
Schwartz et al.

(10) Patent No.: US 7,144,307 B2
(45) Date of Patent: Dec. 5, 2006

(54) POINT SUPERABRASIVE MACHINING OF NICKEL ALLOYS

(75) Inventors: Brian J. Schwartz, West Hartford, CT (US); Daniel F. Grady, Glastonbury, CT (US); Daniel J. Wright, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 244 days.

(21) Appl. No.: 10/400,937

(22) Filed: Mar. 27, 2003

(65) Prior Publication Data

US 2004/0198197 A1 Oct. 7, 2004

(51) Int. Cl.
*B24B 1/00* (2006.01)
*B24B 7/19* (2006.01)
*B24B 7/30* (2006.01)

(52) U.S. Cl. ..... 451/58; 451/41; 451/48

(58) Field of Classification Search ..... 451/41, 451/48, 541, 28, 527, 529, 54, 58
See application file for complete search history.

(56) References Cited

U.S. PATENT DOCUMENTS

| | | | | |
|---|---|---|---|---|
| 2,978,846 | A | 4/1961 | Barron | |
| 4,760,672 | A * | 8/1988 | Darcangelo et al. | 451/42 |
| 4,827,675 | A * | 5/1989 | Andrews | 451/28 |
| 5,044,125 | A * | 9/1991 | Lambert et al. | 451/27 |
| 5,525,096 | A * | 6/1996 | Mayahara et al. | 451/292 |
| 5,704,787 | A * | 1/1998 | Hickok et al. | 433/166 |
| 5,794,725 | A * | 8/1998 | Trujillo et al. | 175/339 |
| 5,906,537 | A * | 5/1999 | Elcock et al. | 451/194 |
| 5,957,223 | A * | 9/1999 | Doster et al. | 175/57 |
| 6,099,605 | A * | 8/2000 | Cook et al. | 51/307 |
| 6,209,420 | B1 * | 4/2001 | Butcher et al. | 76/108.2 |
| 6,331,217 | B1 * | 12/2001 | Burke et al. | 148/522 |
| 2004/0087256 | A1 * | 5/2004 | Schwartz et al. | 451/56 |

FOREIGN PATENT DOCUMENTS

| | | |
|---|---|---|
| GB | 944 283 | 12/1963 |
| GB | 2 038 214 | 7/1980 |
| GB | 2 312 386 | * 10/1997 |

* cited by examiner

*Primary Examiner*—Lee D. Wilson
*Assistant Examiner*—Alvin J. Grant
(74) *Attorney, Agent, or Firm*—Bachman & LaPointe

(57) ABSTRACT

A process for point superabrasive machining of a nickel based material comprising the steps of providing a tool having a grinding surface coated with a superabrasive material, orienting the tool relative to a surface of the nickel based material to be machined so that there is point contact between the surface to be machined and the grinding surface, and forming a part by removing material at the point contract by rotating the tool. The tool comprises an enlarged portion, a tip portion, and a first shaft portion extending from the enlarged portion to the tip portion, the first shaft portion and the tip portion being coated with an abrasive material, and the first shaft portion having a constant diameter.

12 Claims, 2 Drawing Sheets

POINT SUPERABRASIVE MACHINING OF NICKEL ALLOYS

U.S. GOVERNMENT RIGHTS

The Government may have rights in this invention, pursuant to Contract No. N00019-02-C-3003, awarded by the United States Navy.

BACKGROUND OF THE INVENTION

The present invention relates to a process for point superabrasive machining of nickel alloys and to a tool used in the process.

Machining of complex shapes in nickel materials is typically performed using point milling. This technology uses a rotary multi-tooth cutter to remove material. Other more restrictive methods, such as electrochemical machining and flank milling, allow fast machining times but restrict the geometries that can be designed. Because of these restrictions, point milling is often used. This gives the designer maximum flexibility in component design. Point milling however is a relatively slow process when machining high hardness materials such as nickel alloys.

SUMMARY OF THE INVENTION

Accordingly, it is an object of the present invention to provide a process for point superabrasive machining of nickel based materials.

It is a further object of the present invention to provide a tool for use in such a process.

The foregoing objects are met by the process and the tool of the present invention.

In accordance with the present invention, a process for point superabrasive machining of a nickel based material, such as nickel-based alloys, broadly comprises the steps of providing a tool having a grinding surface coated with a superabrasive material, orienting the tool relative to a surface of the nickel based material to be machined so that there is point contact between the surface to be machined and the grinding surface of the tool, and forming a part by removing material at the point contact by rotating the tool.

Further, in accordance with the present invention, a tool for use in point superabrasive machining broadly comprises an enlarged portion, a tip portion, and a first shaft portion extending from the enlarged portion to the tip portion, the first shaft portion and the tip portion being coated with a superabrasive material, and the first shaft portion having a constant diameter.

Other details of the point superabrasive machining of nickel based materials, as well as other objects and advantages attendant thereto, are set forth in the following detailed description and the accompanying drawing, wherein like reference numerals depict like elements.

DETAILED DESCRIPTION OF THE PREFERRED EMBODIMENT(S)

The present invention relates to point superabrasive machining. In this technique, a grinding tool coated with superabrasive grit is rotated at high RPMs to grind off the material.

Figure 1:
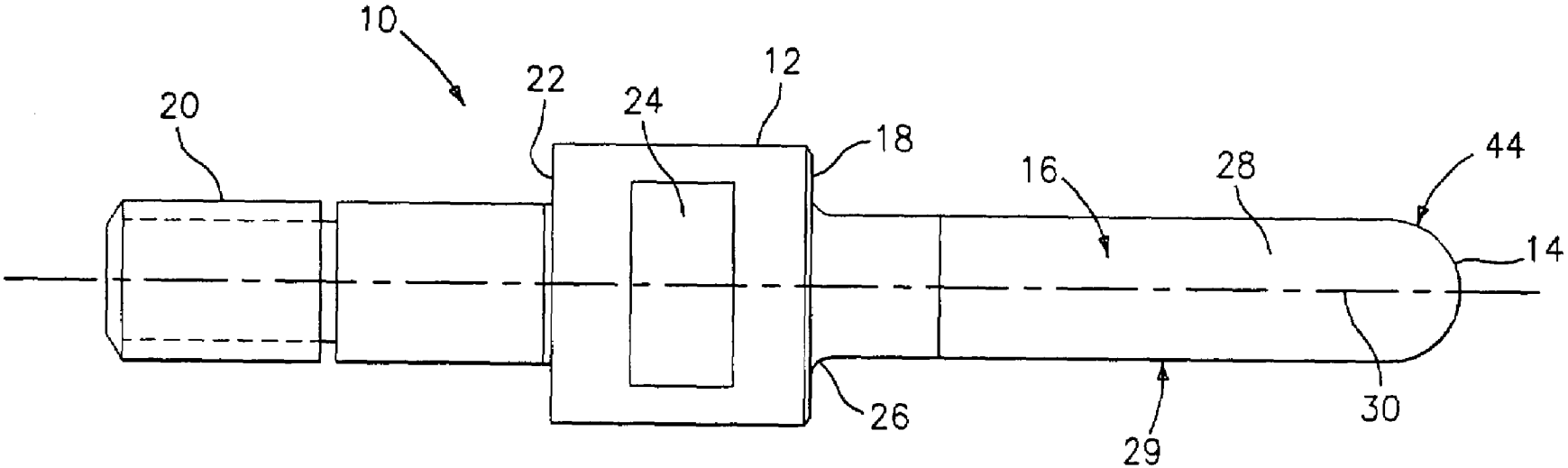
FIG. 1 illustrates a point superabrasive machining tool in accordance with the present invention.

Referring now to FIG. 1, a tool 10 for use in a point superabrasive machining process is illustrated. The tool 10 has an enlarged portion 12, a tip portion 14, and a first shaft portion 16 extending from a first surface 18 of the enlarged portion 12 to the tip portion 14. The tool 10 also has a second shaft portion 20 extending from a second surface 22 of the enlarged portion. The second shaft portion 20 fits into the grinding spindle of a high speed spindle on a machining center machine (not shown).

The tool 10, and in particular the first shaft portion 16, the second shaft portion 20, the enlarged portion 12, and the tip portion 14 may be formed from any suitable tool material known in the art, preferably a steel material. As can be seen from FIG. 1, the enlarged portion 12 has flattened portions 24 for allowing the tool 10 to be tightened and removed using a wrench. Further, the first shaft portion 16 is joined to the enlarged portion 12 by a blend or fillet region 26.

In a preferred embodiment of the present invention, the first shaft portion 16 has a constant diameter along its length and is non-tapered. Unlike tapered tools where, in certain applications, it is not possible to have point contact between the tool and the surface of the material being machined, the non-tapered shaft portion 16 allows for very desirable point contact between the tool 10 and the surface of the material being milled.

As can be seen from FIG. 1, the first shaft portion 16 has a grit material 28 applied to a majority of its length, preferably about 70 to 75% of its length. The superabrasive coating or grit 28 may be applied to the tool using any suitable technique known in the art, such as by electroplating or a vitrified process. Preferably, the superabrasive grit is formed from a superabrasive material selected from the group of cubic boron nitride and vitrified cubic boron nitride. The superabrasive material 28 that coats the tool may have a grit size in the range of 40/45 to 325/400 depending on the depth of the cut and the required surface finish.

The machining center may comprise any suitable computer operated multi-axis grinding or milling machine known in the art.

In operation, a process for point superabrasive milling of a nickel based material broadly comprises the steps of providing the tool 10 and orienting the tool relative to a surface 40 of a nickel based material workpiece 42 so that there is point contact between the surface 40 and the point 44 on the superabrasive coating or grinding surface 28. The tool 10 is then rotated by the machine at a desired speed, preferably in the range of 40,000 to 90,000 revolutions per minute (rpm), to remove material at the point of contact between the point 44 on the tool 10 and the surface 40 so as to form a desired shape in the surface 40. Any suitable coolant and/or lubricant may be applied to the surface 40 and the tool 10 while the material is being removed.

Figure 2:
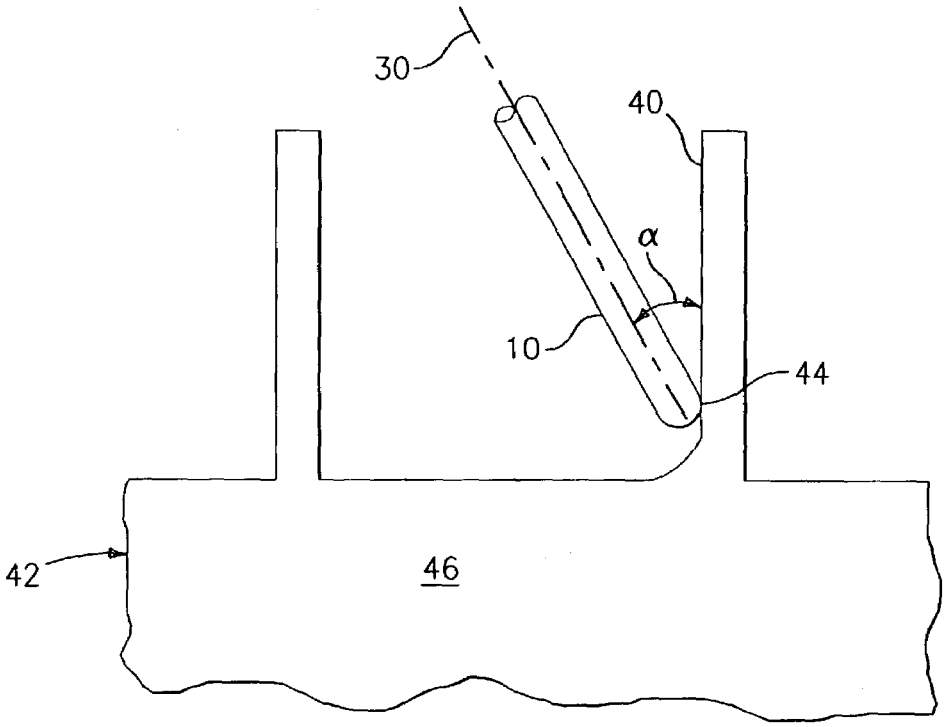
FIG. 2 illustrates the tool of the present invention being used on a workpiece formed from a nickel based material.

The tool 10 may be moved by the pre-programmed, computer operated machine center to provide an airfoil type curvature to the surface 40 and thus form an airfoil member on an integrally bladed rotor or blisk (bladed disk), or the curved elements of an impeller (not shown). The workpiece 42 may have a base component 46 and the tool 10 may be used, as shown in FIG. 2. As can be seen from this figure, the tool 10 may be oriented so that its longitudinal axis 30 is at an angle β with respect to the surface 40.

Figure 3:
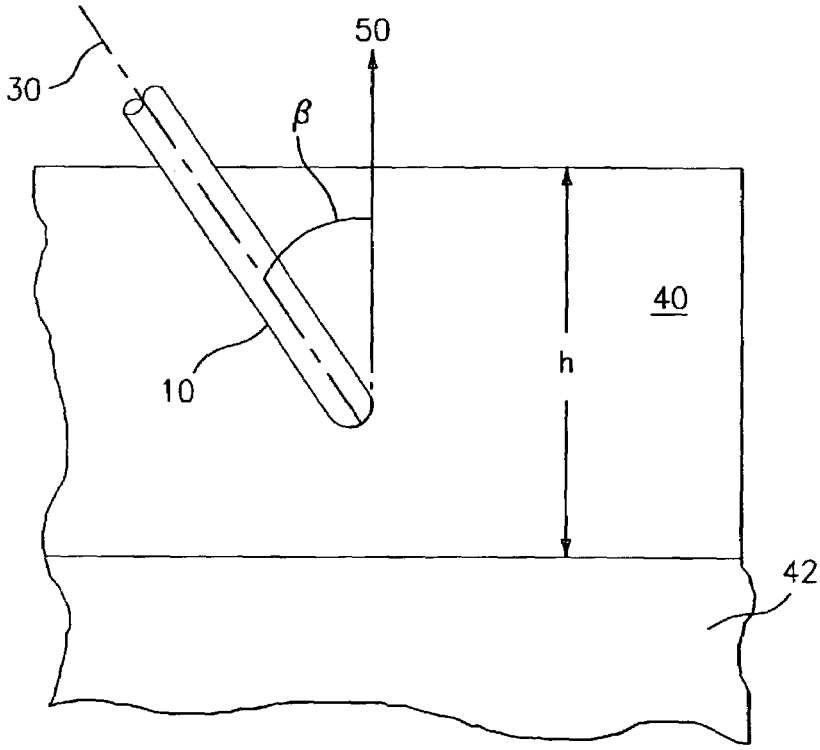
FIG. 3 also illustrates the tool of the present invention being used on a workpiece formed from a nickel based material.

As shown in FIG. 3, the nickel based material workpiece 42 may have a surface 40 which in turn has a height h along a first axis 50. The tool 10, if desired, may be oriented so that the tool longitudinal axis 30 is at an angle β with respect to the axis 50.

If desired, the tool 10 of the present invention may be used to rough machine the workpiece 42 into the shape of a desired part, such as an integrally bladed rotor, blisk, or impeller, prior to using the tool 10 to form part components with a surface 40 with a complex shape. Rough machining may be carried out using the roughing surface 29 on the tool 10.

The tool 10 of the present invention allows material to be removed at much greater speeds and lower loads which avoid causing damage to airfoil members being machined. The tool 10 also allows heat to be dissipated very quickly, which helps avoid the formation of bent grains or white layer in the microstructure. Still further, the tool 10 provides better surface finishes and has an increased tool life. A point superabrasive machining process using the tool 10 of the present invention is faster than a flank milling operation and thus economically beneficial. This is due to the much faster metal removal rates resulting from use of the tool of the present invention. Still another advantage of the tool 10 of the present invention is that it may be used to form engine case shapes from a nickel alloy substrate. In the past, it has been very expensive to machine these shapes due to long machining time required with conventional milling.

It is apparent that there has been provided in accordance with the present invention a process for performing point superabrasive machining of nickel alloys has been provided which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations which fall within the broad scope of the appended claims.

What is claimed is:

1. A process for point superabrasive machining of a nickel based material comprising the steps of:

(a) providing a tool having an enlarged portion, a tip portion, a first shaft extending from said enlarged portion to said tip portion, said first shaft portion and said tip portion being coated with a superabrasive grit material so as to form a grinding surface coated with said superabrasive grit material;

(b) orienting said tool relative to a surface of said nickel based material to be machined so that there is point contact between said surface to be machined and said grinding surface; and (c) forming a part by removing material at said point contact by rotating said tool, wherein said orienting step comprises orienting said tool at an angle relative to said surface to be machined.

2. A process according to claim 1, wherein said rotating step comprises rotating said tool at a speed in the range of 40,000 to 90,000 revolutions per minute.

3. A process according to claim 1, wherein said orienting step comprises said surface having a height along a first axis and orienting said tool at an angle with respect to said first axis.

4. A process for point superabrasive machining of a nickel based material comprising the steps of:

(a) providing a tool having a grinding surface coated with a superabrasive grit material;

(b) orienting said tool relative to a surface of said nickel based material to be machined so that there is point contact between said surface to be machined and said grinding surface; and (c) forming a part by removing material at said point contact by rotating said tool, wherein said tool providing step (a) comprises providing a tool having an enlarged portion, a tip portion, and a constant diameter shaft portion extending between said enlarged portion and said tip portion and having a superabrasive grinding material selected from the group consisting of cubic boron nitride and vitrified cubic boron nitride on said shaft portion and said tip portion.

5. A process according to claim 1, wherein said part forming step (c) comprises forming an airfoil member on an integrally bladed rotor or an impeller.

6. A process according to claim 5, wherein said part forming step further comprises providing a curvature to at least one surface of said airfoil member or impeller using said tool.

7. A process according to claim 5, wherein said part forming step further comprises using said tool to blend said airfoil member into a base member.

8. A tool for use in a point superabrasive machining process comprising:

an enlarged portion, a tip portion, and a first shaft portion extending from said enlarged portion to said tip portion;

said first shaft portion and said tip portion being coated with an abrasive material selected from the group consisting of cubic boron nitride and vitrified cubic boron nitride;

said first shaft portion having a constant diameter; and wherein said enlarged portion has flattened portions for receiving a wrench.

9. A tool for use in a point superabrasive machining process comprising:

an enlarged portion, a tip portion, and a first shaft portion extending from said enlarged portion to said tip portion;

said first shaft portion and said tip portion being coated with an abrasive material;

said first shaft portion having a constant diameter; and further comprising said first shaft portion extending from a first surface of said enlarged portion and a second shaft portion extending from a second surface of said enlarged portion, said second surface being opposed to said first surface, said second shaft portion being narrower than said enlarged portion.

10. A tool according to claim 9, wherein said abrasive material is selected from the group of cubic boron nitride and vitrified cubic boron nitride.

11. A tool according to claim 9, wherein said first shaft portion, said enlarged portion, and said second shaft portion are each formed from steel.

12. A process for point superabrasive machining of a nickel based material comprising the steps of:

(a) providing a tool having a constant diameter shaft portion, and a tip portion, said tip portion and said constant diameter shaft portion each being coated with a superabrasive grit material selected from the group consisting of cubic boron nitride and vitrified cubic boron nitride and forming a grinding surface with said coated tip and shaft portion;

(b) orienting said tool relative to a surface of said nickel based material to be machined so that there is point contact between said surface to be machined and said grinding surface; and (c) forming a part by removing material at said point contact by rotating said tool.

* * * * *